US010182958B2

(12) United States Patent
Gruben et al.

(10) Patent No.: US 10,182,958 B2
(45) Date of Patent: Jan. 22, 2019

(54) FOOTPLATE HARNESS FOR NATURAL KINEMATICS IN WALKING TRAINING APPARATUS

(71) Applicant: Wisconsin Alumni Research Foundation, Madison, WI (US)

(72) Inventors: Kreg George Gruben, Stoughton, WI (US); Wendy Lee Boehm, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 818 days.

(21) Appl. No.: 14/715,062

(22) Filed: May 18, 2015

(65) Prior Publication Data

US 2016/0338896 A1 Nov. 24, 2016

(51) Int. Cl.
*A61H 1/02* (2006.01)
*A61H 1/00* (2006.01)

(52) U.S. Cl.
CPC ..... *A61H 1/0262* (2013.01); *A61H 1/00* (2013.01); *A61H 1/005* (2013.01); *A61H 1/0237* (2013.01); *A61H 2201/1207* (2013.01); *A61H 2201/1215* (2013.01); *A61H 2201/149* (2013.01); *A61H 2201/163* (2013.01); *A61H 2201/1621* (2013.01); *A61H 2201/1642* (2013.01); *A61H 2201/1664* (2013.01); *A61H 2201/501* (2013.01); *A61H 2201/5061* (2013.01); *A61H 2205/08* (2013.01); *A61H 2205/084* (2013.01); *A61H 2205/10* (2013.01); *A61H 2205/12* (2013.01)

(58) Field of Classification Search
CPC ..... A61H 1/0262; A61H 1/0266; A61H 2201/149; A61H 2205/12; A61H 2201/5061; A61H 2201/501; A61H 2201/1215; A61H 2201/1642; A61H 2201/163; A61H 2201/1621; A61H 2201/1664; A61H 1/0237; A61H 1/024; A61H 1/0244; A61H 2001/0248; A61H 2001/0251; A61H 1/0259; A61H 3/00; A61H 2201/0173; A61H 2201/0176; A61H 2201/018; A61H 2201/0184; A61H 2201/12; A61H 2201/164; A63B 22/007; A63B 22/00
USPC ..... 482/70–71, 79
See application file for complete search history.

(56) References Cited

U.S. PATENT DOCUMENTS 430,808 A * 6/1890 Naish ..... A63B 22/0046 482/132
2,016,930 A * 10/1935 McCahan ..... A61H 1/0266 601/27
2,109,188 A * 2/1938 Bajanova ..... A63B 69/0064 182/7
3,695,255 A * 10/1972 Rodgers ..... A61H 1/0266 601/31
3,774,597 A * 11/1973 Root ..... A61H 1/0237 601/27

(Continued)

*Primary Examiner* — Rachel T Sippel
*Assistant Examiner* — Tu Vo
(74) *Attorney, Agent, or Firm* — Boyle Fredrickson, S.C.

(57) ABSTRACT

A walking training device provides substantial fixation of the user's feet against a movable footplate in the direction of the user's stride while allowing toe lift and heel lift necessary for natural walking. The harness system provides an approximation of a shallow crossed four-bar linkage to provide angulation without substantial translation.

20 Claims, 5 Drawing Sheets

(56) References Cited

U.S. PATENT DOCUMENTS 3,824,994 A * 7/1974 Soderberg, Sr. ..... A61H 1/0259 482/51
4,614,180 A * 9/1986 Gardner ..... A61H 9/0078 601/152
7,163,492 B1 * 1/2007 Sotiriades ..... A61H 1/0237 482/51
8,257,284 B2 9/2012 Gruben et al.
9,248,071 B1 * 2/2016 Benda ..... A63B 69/0057
9,713,439 B1 * 7/2017 Wu ..... A61B 5/11
2005/0251067 A1 * 11/2005 Terry ..... A61H 1/0214 601/5
2006/0040804 A1 * 2/2006 Barnard ..... A63B 21/023 482/121
2006/0128537 A1 * 6/2006 Philips ..... A61H 1/0237 482/95
2006/0229167 A1 * 10/2006 Kram ..... A63B 21/00181 482/54
2007/0004567 A1 * 1/2007 Shetty ..... A61H 3/008 482/69
2007/0275830 A1 * 11/2007 Lee ..... A61B 5/1038 482/54
2009/0318267 A1 * 12/2009 Park ..... A61H 3/00 482/8
2010/0075813 A1 * 3/2010 Ochi ..... A61H 1/0237 482/79
2010/0248903 A1 * 9/2010 Cardile ..... A61H 1/0262 482/51
2010/0268129 A1 * 10/2010 Park ..... A61H 1/0237 601/35
2010/0285929 A1 * 11/2010 Bayerlein ..... A61H 1/0237 482/54
2011/0071442 A1 * 3/2011 Park ..... A61H 1/0262 601/35
2011/0256983 A1 * 10/2011 Malack ..... A61H 1/0266 482/4
2012/0296242 A1 * 11/2012 Ochi ..... A61H 1/005 601/5
2013/0053734 A1 * 2/2013 Barriskill ..... A61N 1/36003 601/5
2014/0018216 A1 * 1/2014 Hatfield ..... A63B 21/00185 482/131
2014/0087922 A1 * 3/2014 Bayerlein ..... A63B 22/0235 482/54
2014/0100491 A1 * 4/2014 Hu ..... A61H 3/008 601/27
2014/0256511 A1 * 9/2014 Smith ..... G10H 7/00 482/8
2015/0165265 A1 * 6/2015 Tholkes ..... A63B 22/0664 482/54
2015/0250675 A1 * 9/2015 Kalinowski ..... A61H 3/008 482/69
2015/0257965 A1 * 9/2015 Simeone ..... A63B 69/0064 482/146
2016/0022440 A1 * 1/2016 Ha ..... A61F 2/68 623/24
2017/0027803 A1 * 2/2017 Agrawal ..... A61B 5/6828

* cited by examiner

FOOTPLATE HARNESS FOR NATURAL KINEMATICS IN WALKING TRAINING APPARATUS

STATEMENT REGARDING FEDERALLY SPONSORED RESEARCH OR DEVELOPMENT

--

CROSS REFERENCE TO RELATED APPLICATION

--

BACKGROUND OF THE INVENTION

The present invention relates to a device for training human limb motion and in particular to a device that trains a walking user.

Walking impairment can be caused by disorders of the central nervous system, peripheral nervous system, and musculoskeletal system. Strokes, for example, which occur when blood flow to a region of the brain is obstructed, are a leading cause of severe long-term disability. Studies have shown that while many stroke sufferers have adequate strength at each joint, for example, for walking, the stroke may make it difficult for the sufferer to coordinate this strength for walking.

Rehabilitation efforts for stroke victims often use conventional exercise equipment to retrain correct limb motion. Such exercise equipment, for example, a stationary bicycle, provides resistance along a constrained path of movement that is intended to approximate a desired path of movement that the patient is trying to learn. This constraint may hide basic errors in muscle activation patterns and/or promote compensating behaviors by the patient without addressing the underlying muscle activation errors.

Effective training of walking can be difficult because some constraint on the motion of the patient is required to keep the patient safe, to couple the patient to the training device for measurement, and to apply training motion and forces.

SUMMARY OF THE INVENTION

The present invention provides a harness that may be used to provide mechanical coupling between a patient's feet and footplates on a training apparatus, where the footplates are supported for forward and backward motion and/or force measurement. The harness accommodates the heel lift and toe lift needed for natural walking while still closely coupling the patient's foot to the footplate with respect to motion along the stride axis. In this respect, the invention provides a balancing between foot motion guidance and foot motion freedom to permit effective training of disordered walking.

Specifically, in one embodiment, the invention provides a walking training apparatus having left and right footplates for support of a standing patient having one foot on the left footplate and one foot on the right footplate so that a front portion of each footplate is proximate to the patient's toes and a rear portion of each footplate proximate to the patient's heel. Left and right footplate support assemblies provide at least one of forward and backward motion of the left and right footplate along a stride axis of the patient and measurement of forces by the patient against the left and right footplate. A left and right harness releasably attach the patient's feet to the left and right footplates, each harness providing: (a) a first flexible tension element flexibly extending between a front of the patient's foot and an attachment point at a rear of each footplate and (b) a second flexible tension element flexibly extending between a rear of the patient's foot and an attachment point at a front of each footplate.

It is thus a feature of at least one embodiment of the invention to provide a harness attachment that substantially prevents slippage between the foot and footplate while allowing heel lift, toe lift, and minor eversion, inversion, and axial rotation necessary for a normal stride.

The first flexible tension element may provide a toe pocket receiving a toe of a shoe worn by the patient, and the second flexible tension element provides a heel pocket receiving a heel of a shoe worn by the patient.

It is thus a feature of at least one embodiment of the invention to provide a harness that works with a shoe (including the patient's own shoes) to provide a simple robust attachment to the patient's feet.

The harness may further include length-adjustable connections between the first flexible tension element and second flexible tension element allowing respective pockets of the first flexible tension element and second flexible tension element to be drawn together about a patient's shoe.

It is thus a feature of at least one embodiment of the invention to provide a harness that may accommodate a variety of different patient and shoe sizes.

The length-adjustable connections may include buckles permitting separation of the first flexible tension element and second flexible tension element.

It is thus a feature of at least one embodiment of the invention to simplify attachment and detachment of the harness by allowing separation of the harness into two elements.

The first flexible tension element and second flexible tension element may be woven straps sewn to form open pouches providing the toe pocket and heel pocket.

It is thus a feature of at least one embodiment of the invention to provide a flexible harness constructed of woven straps having high tensile strength that may be securely attached to the shoe.

The first flexible tension element may provide two flexible bands extending from left and right sides of the toe pocket to a pair of attachment points at the rear of each footplate flanking at least one flexible band extending from the heel pocket to at least one attachment point at the front of each footplate.

It is thus a feature of at least one embodiment of the invention to provide additional stability to the toe of the patient's feet as they advance in the normal stride. The flanking arrangement prevents interference between the tensile elements.

The attachment point of the first flexible tension element and the second flexible tension element to the footplate may provide a releasable connection releasing under a predetermined force achievable by leg strength alone.

It is thus a feature of at least one embodiment of the invention to provide a harness that may be rapidly released from the footplate by the patient if necessary, for example, to regain balance.

The attachment points may be provided by inter-engaging hook and loop fastener material.

It is thus a feature of at least one embodiment of the invention to provide a releasable attachment mechanism that is relatively resistant to shear forces generated during a normal stride but easily separated, for example, by upward lifting of the foot.

The harness may further include an electrical sensor attached to at least one of the first flexible tension element and second flexible tension element to provide an indication of a predetermined separation of at least one first flexible tension element and, second flexible tension element from its respective left or right footplate.

It is thus a feature of at least one embodiment of the invention to allow the harness to signal a stepping off of the footplate, for example, to provide an indication to a health-care professional or to affect operation of the walking apparatus.

The electrical sensor may be an electrical conductor attached to at least one of the first flexible tension element and second flexible tension element communicating with at least one releasable electrical connector to break a circuit at the predetermined separation of at least one first flexible tension element and second flexible tension element from its respective left or right footplate.

It is thus a feature of at least one embodiment of the invention to provide an electrical sensor that naturally fails in a safe mode by signaling not only when the patient's foot is removed from the footplate but also if the sensor wire or connectors are broken.

The walking training apparatus may include motors for providing forward and backward motion of the left and right footplate along the stride axis and a controller communicating with the electrical sensor and the motors to respond to the indication for stopping motion of the footplates.

It is thus a feature of at least one embodiment of the invention to allow any motorized motion of the footplates to be immediately stopped if the patient loses contact with the footplates.

The controller and the motors may provide for a periodic forward and reverse motion of the left and right footplates to mimic a natural stride in which the footplates move out of phase with respect to each other.

It is thus a feature of at least one embodiment of the invention to provide a harness particularly suitable for motor-actuated footplates that permits natural stride under such circumstances.

The footplate support assemblies may provide measurements of force applied by the footplate to the footplate support and may include an output display for displaying the measurements of force.

It is thus a feature of at least one embodiment of the invention, to provide a harness that accommodates instrumentation of leg and foot forces during contact with the footplates. This force measurement may be used to control the footplate motor actuation.

The walking training apparatus may include a framework holding the footplates and footplate supporting assemblies, the framework providing upwardly extending support structures attached to restrain lines communicating with a shoulder and hip harness receivable by the patient's shoulders and hip to provide motion restraint on a patient supported on the footplates during walking.

It is thus a feature of at least one embodiment of the invention to provide for angular stabilization for patients attempting to relearn balance during walking.

The restraints may provide a nonlinear spring-biasing force to the shoulder and hip harness.

It is thus a feature of at least one embodiment of the invention to allow the patient to explore the boundaries of their balance capabilities without risk of falling by providing relatively low restoring force for low angular displacements rising quickly to a stiff restraining force for high angular displacements.

The restraints may communicate with force and angle sensors mounted to the framework to indicate forces and angles of forces applied to the harnesses by the patient during walking.

It is thus a feature of at least one embodiment of the invention to provide measurements of walking ability to provide positive feedback to the patient or analysis of the patient's walking problems for better training.

These particular objects and advantages may apply to only some embodiments falling within the claims and thus do not define the scope of the invention.

DETAILED DESCRIPTION OF THE PREFERRED EMBODIMENT

Figure 1:
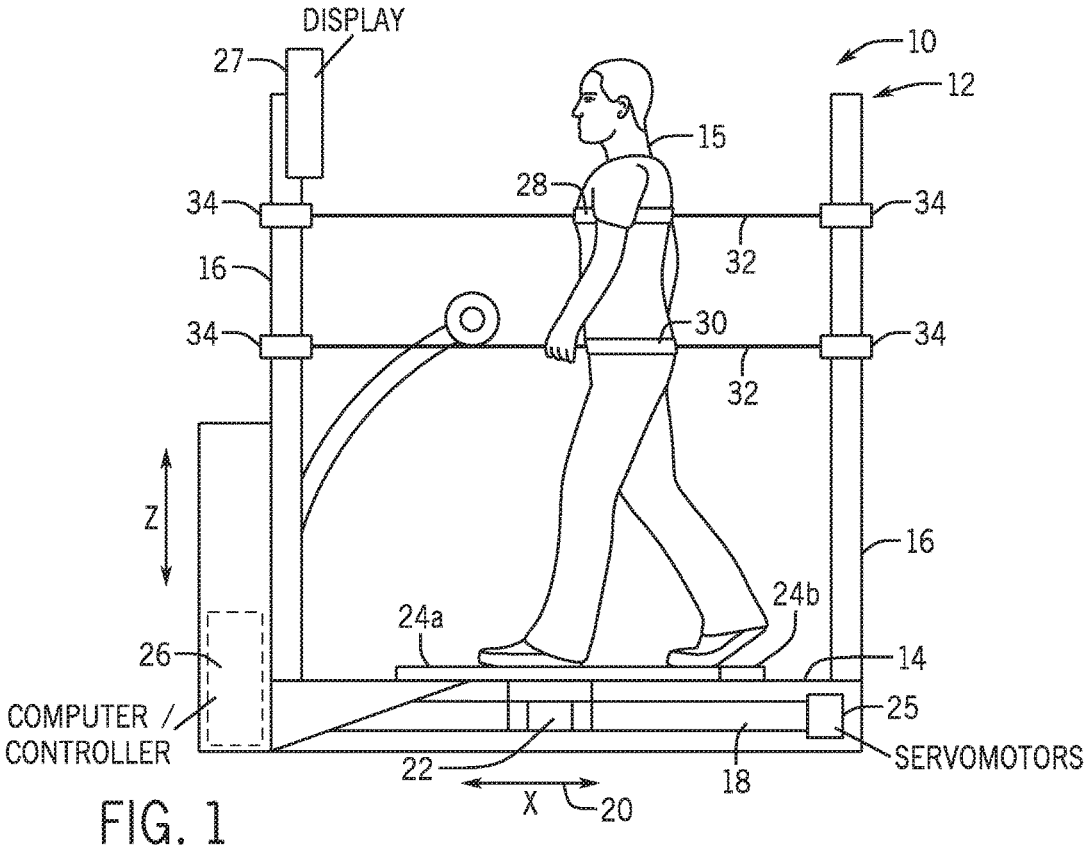
FIG. 1 is a left-side, elevational view of a walking training apparatus of the present invention showing a patient standing on left and right footplates while walking and supported by stabilizing restraints communicating with the patient's hip and shoulder harness.
Figure 2:
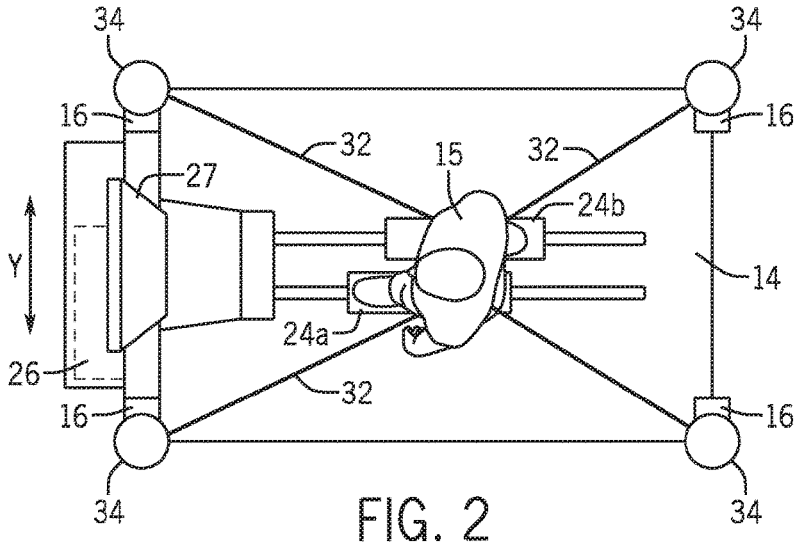
FIG. 2 is a top plan view of the walking training apparatus of FIG. 1.

Referring now to FIGS. 1 and 2, a walking training apparatus 10 may provide for a framework 12 providing generally a horizontal rectangular platform 14 supported against the floor. The framework 12 may provide columns 16 extending upward from the corners of the platform 14 to a point above the shoulder height of an average patient 15 standing on the platform 14.

Beneath an upper surface of the platform 14, a bearing track 18 extends generally along a stride axis 20 aligned with a stride direction of the patient 15. The stride axis 20 is generally the direction of motion of the patient's feet during walking. The bearing track 18 supports left and right carriages 22 for sliding along the bearing track 18. Each of the left and right carriages 22 provides a portion which extends upward through the upper surface of the platform 14 to attach to corresponding left and right footplates 24*a* and 24*b*.

The footplates 24 are generally coplanar and horizontal and may receive and support the patient's 15 feet during walking motion.

Servomotors 25 connect via belts to the carriages 22 to provide controlled motion of the footplates 24 in the direction of the stride axis 20 under the control of a computer/controller 26. As is understood in the art, the computer/controller 26 may include a processor and computer memory, the latter of which may hold programs stored in non-transient media for implementing various operations to be described below. The computer/controller 26 may be positioned adjacent to the framework 12 and may communicate with a display 27 visible by the patient 15 walking in the walking training apparatus 10 for receiving visual guidance during walking training.

The carriages 22 will preferably include instrumentation (for example, load cells) measuring forces along each of three Cartesian axes (positive and negative forces along each axis) and torques about each of the Cartesian axes (positive and negative torques along each axis). These measurements will be communicated to the computer/controller 26 and may provide for the display of information derived from these measurements on the display 27.

A shoulder harness 28 and hip harness 30 fit about the shoulders and hips of the patient 15, respectively, and communicate by means of flexible restraint straps 32 with force sensitive actuators 34 attached to the columns 16 at shoulder and hip height, respectively. Thus, four restraint straps 32 separated in a horizontal plane by approximately 90 degrees communicate between the shoulder harness 28 and corresponding force-sensitive actuators 34 on each of the columns 16 and four restraint straps 32 also separated in a horizontal plane by 90 degrees, the plane being parallel to and below that of the shoulder harness 28, and communicate between the hip harness 30 and corresponding force-sensitive actuators 34 on each of the columns 16.

Figure 3:
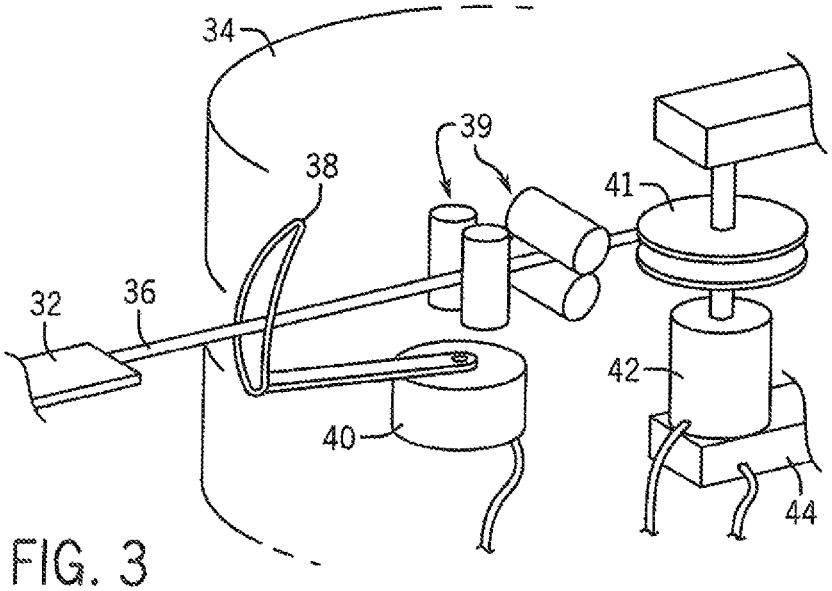
FIG. 3 is a phantom view of a force-sensitive actuator to which the stabilizing restraints are attached and which may measure force magnitude and force angle on the restraints.

Referring now to FIG. 3, each force-sensitive actuator 34 receives a restraint cord 36 leading from the restraint straps 32 which may pass through a follower arm 38 pivotally attached to an angle resolver 40. The angle resolver 40 pivots about a vertical pivot axis so that the angle of force exerted by the patient 15 on the restraint strap 32 within a horizontal plane may be determined and provided to the computer/controller 26. The cord 36 may then pass through a set of centering rollers 39 and in one embodiment may be fixedly attached with respect to the columns 16 or, as shown, may be received by a spool 41 driven by a force motor/resolver 42 allowing a computer-controlled force to be applied to the cord 36 and the extension of the cord 36 to be measured. In both cases of the cord 36 being fixed or attached to the spool 41, the force between the cord 36 and the column 16 may be measured by means of a load cell 44 communicating with the computer/controller 26.

Figure 4A:
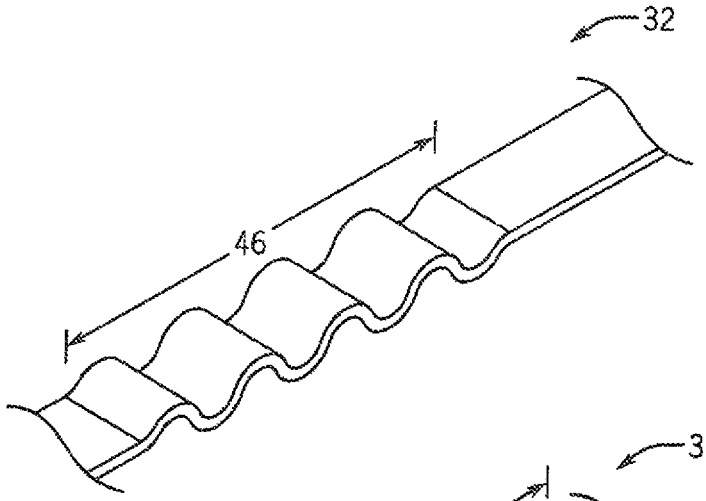
FIGS. 4*a* and 4*b* are fragmentary perspective views of a section of the stabilizing restraints in differing extensions demonstrating the non-linear elastic properties of the restraints.
Figure 4B:
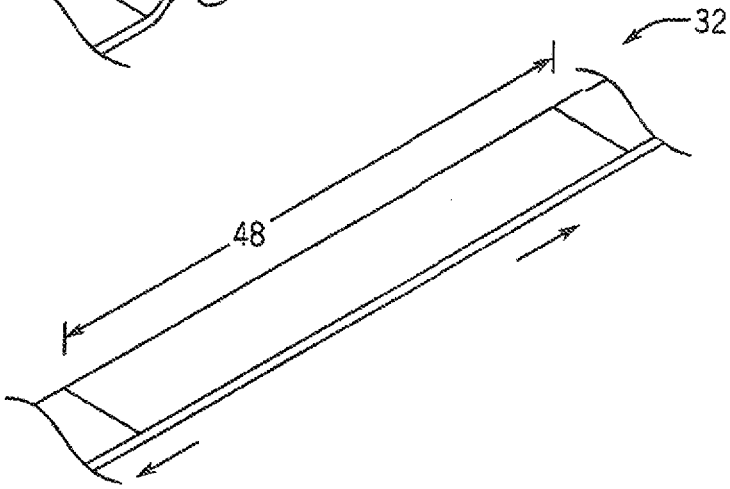

Referring now to FIG. 4, when the cord restraint strap 32 is fixedly attached to the columns 16, it may include an elastic portion 46 that applies a restoring force to the patient 15 at all times when the patient is not properly vertically aligned. Restoring three is a nonlinear function of the extension of the elastic portion 46 which provides for some ability for the patient 15 to move during normal walking or experimentation with balance. Excessive leaning of the patient 15 from vertical will cause the elastic portion 46 to reach a stretch limit 48 where further extension of the elastic portion 46 is fully resisted by substantially inelastic cords of the restraint strap 32 providing an abrupt nonlinearity in the spring-biasing force and protecting the patient 15 from instability.

Figure 5:
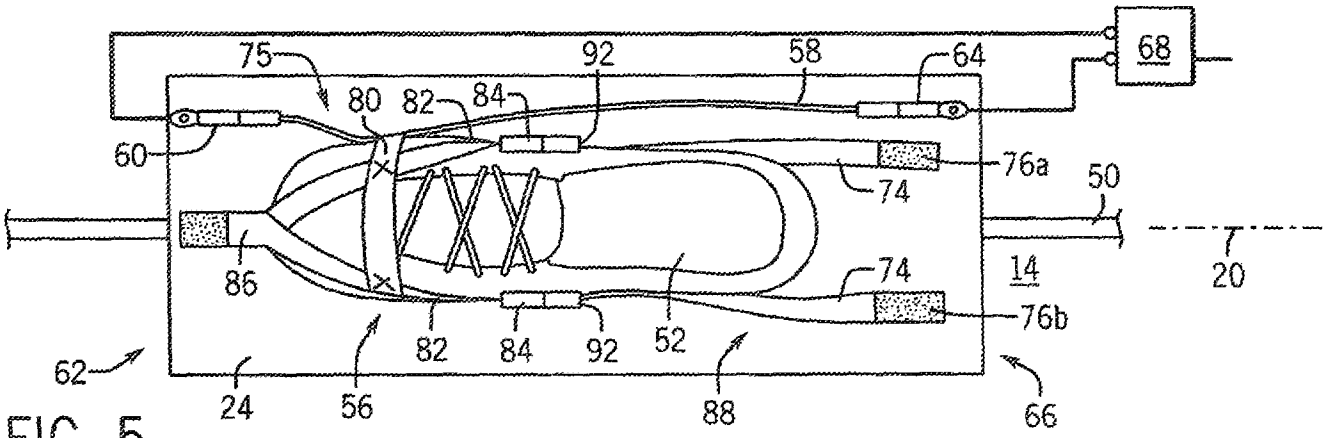
FIG. 5 is a top plan view of one footplate of FIG. 1 showing a shoe attached by a shoe harness and safety wire to the footplate.

Referring now to FIG. 5, each footplate 24 may generally be movable along stride axis 20 as discussed above, for example, communicating through the surface of the platform 14 by means of slots 50 to the underlying carriages 22 which may move to provide for stride-related motion of the footplates 24. The patient's foot (not shown in FIG. 5) may be received within a shoe 52, for example, being a general-purpose walking or running athletic shoe roughly centered within the rectangular area of the footplate 24 and held by a harness 56 thereto. Generally the harness 56 will limit displacement of the patient's foot and shoe 52 along the stride axis 20 with respect to the center of the footplate 24. That is, the harness 56 will prevent motion between the shoe 52 and the footplate 24 in the direction of the stride axis 20. Nevertheless, the harness 56 will allow toe lift and heel lift (as described below), minor inversion and eversion of the foot and minor rotation about a vertical axis necessary for natural walking.

The harness 56 is attached to a safety wire 58 that electrically communicates between a releasable electrical connector 60 at a front end 62 of the footplate 24 and a releasable electrical connector 64 at a rear end 66 of the footplate 24. Excessive motion of the harness 56 will cause one of the connectors 60 and 64 to be disconnected thereby communicating a loss of electrical continuity to an alarm detector 68. The alarm detector 68 may communicate with the computer/controller 26 such as may be used to stop motion of the footplates 24 or provide an alarm or the like.

Figure 6:
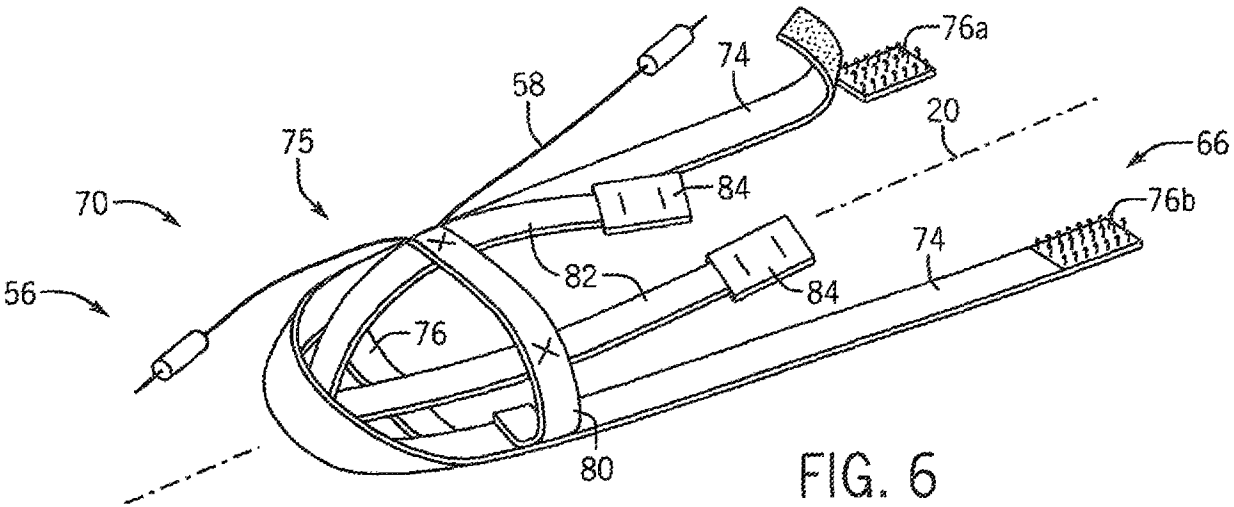
FIG. 6 is a perspective view of a toe portion of the harness of FIG. 5.
Figure 7:
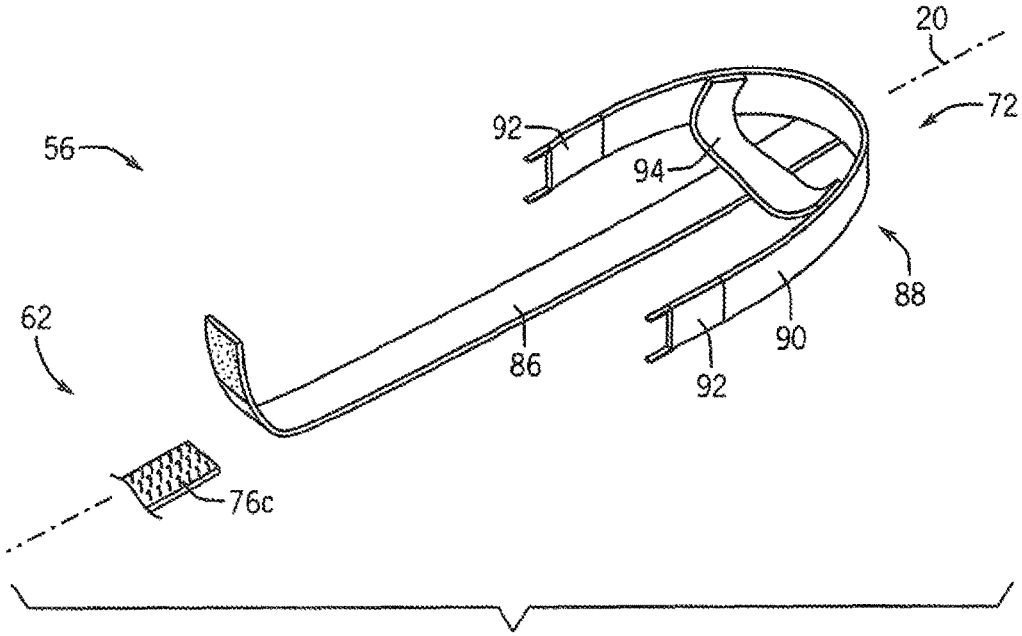
FIG. 7 is a perspective view of the heel portion of the harness of FIG. 5.

Referring now to FIGS. 5, 6 and 7, each harness 56 may generally include a toe portion 70 and a heel portion 72 that operate together to restrain a shoe 52 holding the foot of the patient 15. The toe portion 70 may include a first U-shaped flexible strap 74 extending from a first attachment point **76*a* at a right side of the rear end 66 of the footplate 24 and looping around the toe of the shoe 52 to a second attachment point 76*b* at a left side of the rear end 66 of the footplate 24. The strap 74 may be attached at the attachment points 76 by means of inter-engaging hook and loop fasteners, different portions situated on different ones of the strap 74 footplate 24. These hook and loop fasteners are more resistant to shear forces (and thus help stabilize the position of the shoe 52 along the stride axis 20) but readily disconnect under normal force by the patient 15, for example, if the patient 15** needs to rapidly reposition his or her foot for safety.

The loop of the strap 74 proximate the toe of the shoe 52 is formed into a toe pocket 75 by means of an underlying strap 78 fitting under the toe of the shoe 52 and extending laterally to be attached at its left and right, ends to the strap 74 and an overlying strap 80 fitting over the toe of the shoe 52 also attached at its left and right ends to the strap 74. The toe pocket 75 serves to attach the strap 74 to the toe of the shoe 52.

An apex of the loop formed by the strap 74 may attach to left and right rearwardly extending shoe retention straps 82 terminating in adjustable buckles 84 of a type known in the art. Each of the straps 78 and 82 may also be constructed of the same material as strap 74 (for example, a nylon webbing) and assembled together by stitching.

The heel portion 72 may include a single medial flexible strap 86 extending from a third attachment point **76*c* at a front end 62 of the footplate 24 centered between the left and right edges of the footplate 24. The strap 86 may be attached at the attachment point 76*c* by means of inter-engaging hook and loop fasteners, one on the end of the strap 86 and the other fixed to the footplate 24** as discussed above.

The remaining end of the medial flexible strap 86 attaches to the heel of the shoe 52 by means of a heel pocket 88 formed by a U-shaped heel strap 90 attached at its center to an unattached end of medial strap 86 and curving about the heel of the shoe 52 and forward, to terminate at buckle portions 92 receivable by buckles 84. The end of the strap 86 proximate to the heel attaches at its center to laterally extending strap 94 fitting beneath the heel of the shoe 52 to be attached to strap 90 at its opposite ends thereby completing the heel pocket 88.

Each of the straps 86, 90, 94 may also be constructed of the same material as strap 74 and assembled together by stitching.

Adjustment of the length of the straps 82 through the buckles 84 allows the toe pocket 75 and heel pocket 88 to be drawn together about the shoe 52 to prevent substantial slippage between the shoe and the harness 54. As so assembled, the medial flexible strap 86 is generally centered between the opposed arms of strap 74 to prevent interference between the strap 74 and 86.

Figure 8:
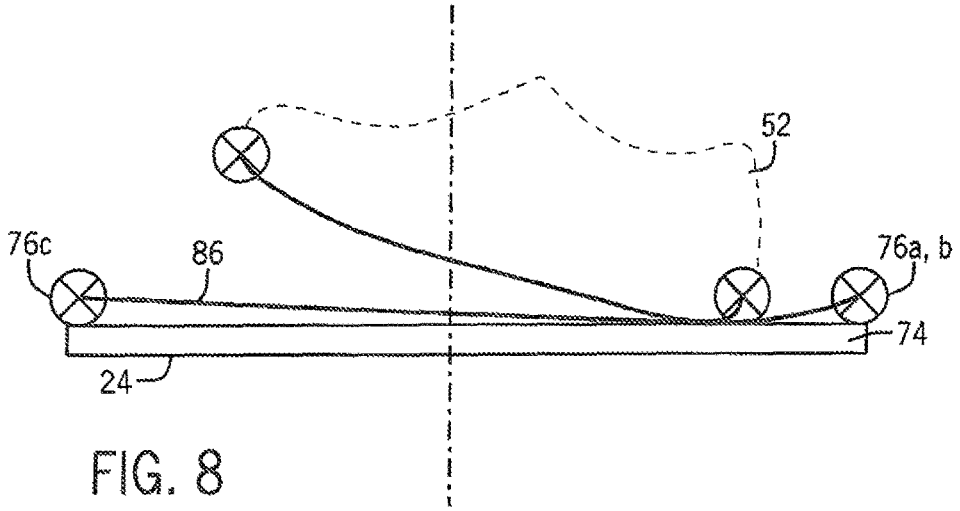
FIG. 8 is a simplified side view of the patient's foot during a forward leg extension of a normal stride showing a toe lift accommodated by the harness.

Referring now to FIG. 8, during a normal stride by the patient 15, when the footplate 24 is in a forward position and the patient's leg extended forwardly, the patient's heel may be against the footplate 24 and the toe elevated. At this time both strap 74 and strap 86 may be substantially without slack (in slight tension) to prevent forward or backward movement of the toe of the shoe 52 with respect to the footplate 24. Toe and heel lifting is possible based on the geometry of the straps; however, motion in the direction of the stride axis 20 is largely resisted by the routing of the straps below the foot and the shallow angle of straps 74 and 86 and the close proximity of the attachment points 76*c* and 76*a* and 76*b* along the stride axis 20. Little or no strap elasticity is required. Generally the axial separation 77 of the attachment points of the straps 74 and 86 to the shoe 52 will be more than half the axial separation 79 of the attachment points of the straps 74 and 86 to the footplate 24. Note that the strap 74 may be in part trapped beneath the heel of the shoe 52 further serving to limit axial movement of the shoe 52 with respect to the footplate 24 and to preserve tension in the straps 74 and 86

Figure 9:
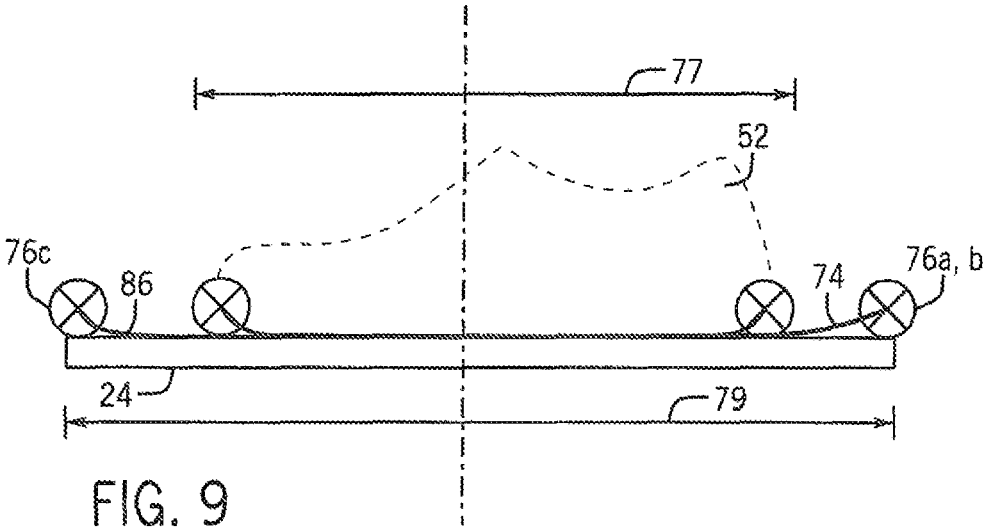
FIG. 9 is a figure similar to that of FIG. 8 showing a centerpoint of a nasal stride showing the foot without toe lift or heel lift.

As the footplate 24 moves rearwardly, the shoe 52 in a normal stride will arrive to lie flat against the upper surface of the footplate 24 with neither the heel nor toe elevated as shown in FIG. 9. In this position, minor tension on the straps 74 and 86 continues to hold the relative location of the foot with respect to the footplate 24.

Figure 10:
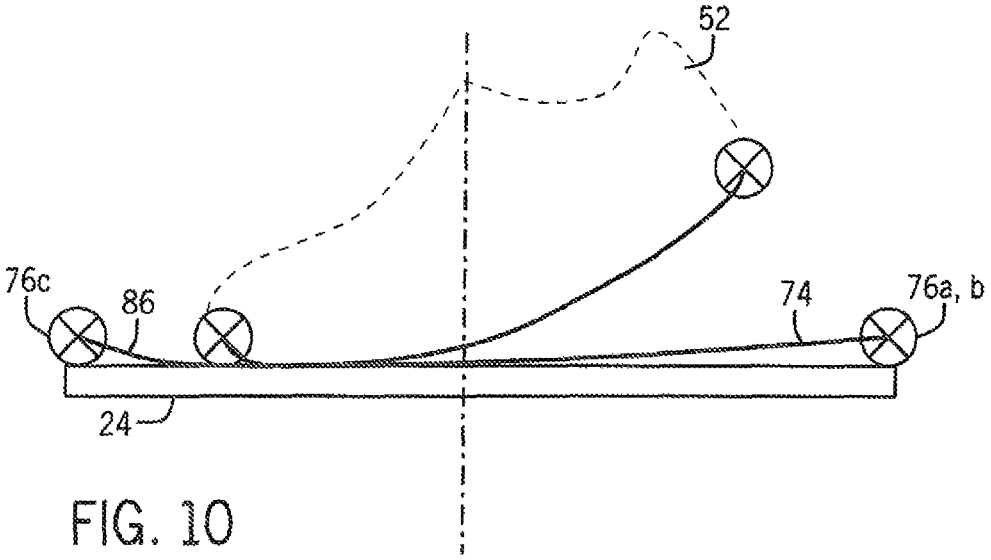
FIG. 10 is a figure similar to FIGS. 8 and 9 showing a rear leg extension of the normal stride and resulting heel lift accommodated by the harness.

Finally, as shown in FIG. 10 when the footplate 24 is in the rearmost position, the heel of the shoe 52 may rise as is permitted by the geometry of the attachment of the straps 86 and 74 while still providing slight tension between the toe along strap 74 and the attachment point 76 and the heel along strap 86 with attachment point 76*c* still preserving relative fixation of the shoe 52 with respect to the footplate 24. In contrast to FIG. 8, here the strap 86 may be in part trapped beneath the toe of the shoe 52 preventing slack in the straps 76 and 74 and providing improved localization of the shoe 52.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A walking training apparatus comprising:

a left footplate and right footplate for support of a standing patient having one foot on the left footplate and one foot on the right footplate so that a front portion of each footplate is proximate to toes of the patient and a rear portion of each footplate proximate to a heel of the patient;

a footplate support platform cooperating with the left footplate and right footplate to provide at least one of forward and backward motion of the left and right footplate along a stride axis of the patient, and measurement of forces by the patient against the left and right footplate; and a left harness and right harness releasably attaching the patient's feet to the left and right footplates, each harness providing:

(a) a first flexible tension element having a first end and second end, the first end of the first flexible tension element attached to a toe pocket proximate to and fixed with respect to a front of the patient's foot and the second end of the first flexible tension element attached to a rear attachment point proximate to and fixed with respect to a rear of each of the left and right footplates; wherein during operation of the walking training apparatus, the first flexible tension element and the toe pocket are configured to rotate about a horizontal axis with respect to the rear attachment point of the left and right footplates thereby allowing toe lift; and (b) a second flexible tension element having a first end and second end, the first end of the second flexible tension element attached to a heel pocket proximate to and fixed with respect to a rear of the patient's foot and the second end of the second flexible tension element attached to a front attachment point proximate to and fixed with respect to a point at a front of each of the left and right footplates; whereby during operation of the walking training apparatus, the second flexible tension element and the heel pocket are configured to rotate about a horizontal axis with respect to the front attachment point of each of the left and right footplates thereby allowing heel lift;

whereby the patient's feet are held against slippage with respect to a corresponding footplate along the stride axis while allowing toe lift and heel lift.

2. The walking training apparatus of claim 1, wherein the toe pocket is adapted to receive a toe of a shoe worn by the patient and the heel pocket is adapted to receive a heel of a shoe worn by the patient and wherein the first and second flexible tension elements are woven straps.

3. The walking training apparatus of claim 2, further including length-adjustable connections between the heel pocket and the toe pocket allowing the respective heel pocket and toe pocket of the first flexible tension element and second flexible tension element to be drawn together about a patient's shoe.

4. The walking training apparatus of claim 3, wherein the length-adjustable connections include buckles permitting separation of the first flexible tension element and second flexible tension element.

5. The walking training apparatus of claim 2, wherein the first flexible tension element and second flexible tension element include woven straps sewn to form open pouches providing the toe pocket and heel pocket.

6. The walking training apparatus of claim 2, wherein the first flexible tension element provides two flexible bands extending from left and right sides of the toe pocket to a pair of attachment points at the rear of each footplate flanking at least one flexible band extending from the heel pocket to at least one attachment point at the front of each footplate.

7. The walking training apparatus of claim 1, further including a shoe held by the harness and wherein the first and second flexible tension elements are substantially taut.

8. The walking training apparatus of claim 1, wherein the rear attachment point of the first flexible tension element to the footplate and the front attachment point of the second flexible tension element to the footplate each provide a releasable connection adapted to release under a predetermined force achievable by leg strength alone.

9. The walking training apparatus of claim 8, wherein the front and rear attachment points are provided by interengaging hook and loop fastener material.

10. The walking training apparatus of claim 1, further including an electrical sensor attached to at least one of the first flexible tension element and second flexible tension element to provide an indication of a predetermined separation of at least one first flexible tension element and second flexible tension element from a respective one of the left or right footplates.

11. The walking training apparatus of claim 10, wherein the electrical sensor is an electrical conductor attached to at least one of the first flexible tension element and second flexible tension element communicating with at least one releasable electrical connector to break a circuit communicating with the releasable electrical connector at the predetermined separation of at least one first flexible tension element and second flexible tension element from a respective one of the left or right footplate.

12. The walking training apparatus of claim 10, further including motors for providing forward and backward motion of the left and right footplate along the stride axis and a controller communicating with the electrical sensor and the motors to respond to the indication for stopping motion of the footplates.

13. The walking training apparatus of claim 12, wherein the controller and the motors provide for a periodic forward and reverse motion of the left and right footplates to mimic a natural stride in which the footplates move out of phase with respect to each other.

14. The walking training apparatus of claim 12, wherein the footplate support platform uses the measurement of forces by the patient against the left and right footplate to control the motors.

15. The walking training apparatus of claim 1, further including an output display receiving the measurement of forces by the patient against the left and right footplate for displaying the measurement of forces by the patient against the left and right footplate.

16. The walking training apparatus of claim 15, wherein the measurements of force include force along Cartesian axes and torque about the Cartesian axes.

17. The walking training apparatus of claim 1, wherein the footplate supporting platform provides a framework providing upwardly extending support structures attached to restraint lines communicating with a shoulder and hip harness receivable by the patient's shoulders and hip to provide motion restraint on a patient supported on the footplates during walking.

18. The walking training apparatus of claim 17, wherein the restraint lines provide a nonlinear spring-biasing force to at least one shoulder and hip harness.

19. The walking training apparatus of claim 17, wherein the restraint lines communicate with force and angle sensors mounted to the framework to indicate forces and angles of forces applied to at least one harness by the patient during walking.

20. The walking training apparatus of claim 17, wherein the restraint lines communicating with the patient's shoulder are at a first horizontal plane and the restraint lines indicating with the patient's hips are in a second horizontal plane parallel to the first horizontal plane.

* * * * *